US011091706B2

(12) United States Patent
Hu

(10) Patent No.: US 11,091,706 B2
(45) **Date of Patent: *Aug. 17, 2021**

(54) HYDROCRACKING PROCESS FOR MAKING MIDDLE DISTILLATE FROM A LIGHT HYDROCARBON FEEDSTOCK

(71) Applicant: SHELL OIL COMPANY, Houston, TX (US)

(72) Inventor: Michael Chiun-Kuei Hu, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/419,872

(22) Filed: May 22, 2019

(65) Prior Publication Data

US 2019/0359897 A1 Nov. 28, 2019

Related U.S. Application Data

(63) Continuation of application No. 62/676,406, filed on May 25, 2018.

(51) Int. Cl.

| | |
|---|---|
| ***C10G 65/10*** | (2006.01) |
| ***C10G 7/00*** | (2006.01) |
| ***C10G 47/16*** | (2006.01) |
| ***C10G 47/36*** | (2006.01) |

(52) U.S. Cl.

CPC ..... *C10G 65/10* (2013.01); *C10G 7/00* (2013.01); *C10G 47/16* (2013.01); *C10G 47/36* (2013.01); *C10G 2300/1059* (2013.01); *C10G 2400/04* (2013.01)

(58) Field of Classification Search

CPC ..... C10G 47/16; C10G 47/36; C10G 65/02; C10G 65/10; C10G 65/12; C10G 2300/1059

See application file for complete search history.

(56) References Cited

U.S. PATENT DOCUMENTS

| | | | | |
|---|---|---|---|---|
| 3,726,788 | A | 4/1973 | Trythall | |
| 3,816,296 | A * | 6/1974 | Hass | C10G 47/00 208/111.3 |
| 6,190,538 | B1 | 2/2001 | Gosselink et al. | |
| 7,048,845 | B2 | 5/2006 | Bauer | |
| 7,192,900 | B2 | 3/2007 | Creyghton et al. | |
| 7,749,373 | B2 | 7/2010 | Hansen et al. | |
| 8,318,006 | B2 | 11/2012 | Benazzi et al. | |
| 2003/0085154 | A1 * | 5/2003 | Benazzi | C10G 65/12 208/89 |
| 2007/0084751 | A1 * | 4/2007 | Wang | C10G 47/16 208/59 |
| 2009/0100746 | A1 | 4/2009 | Lopez et al. | |
| 2013/0264246 | A1 | 10/2013 | Holtzer et al. | |
| 2015/0159095 | A1 * | 6/2015 | Zhan | C10G 47/18 208/95 |

OTHER PUBLICATIONS

International Search Report and Written Opinion Received for PCT Application No. PCT/US2019/033585, dated Aug. 13, 2019, 9 pages.

International Search Report and Written Opinion Received for PCT Application No. PCT/US2019/033567, dated Aug. 13, 2019, 10 pages.

* cited by examiner

*Primary Examiner* — Prem G Singh
*Assistant Examiner* — Brandi M Doyle
(74) *Attorney, Agent, or Firm* — Shell Oil Company

(57) ABSTRACT

A two-stage hydrocracking process for preferentially making a high-quality middle distillate product such as diesel from a relatively light hydrocarbon feedstock such as light vacuum gas oil.

6 Claims, 1 Drawing Sheet

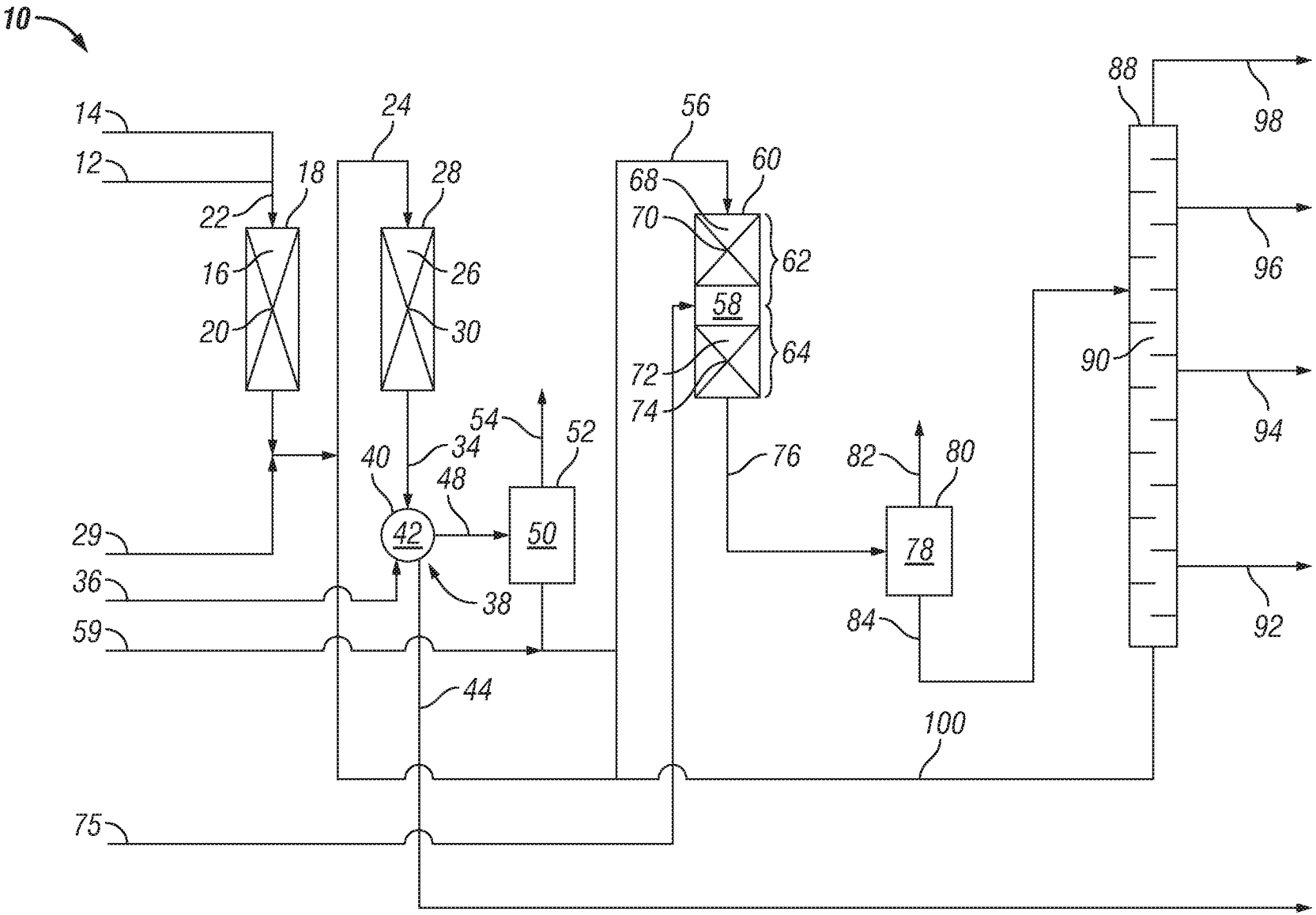
10
12
14
16
18
20
22
24
26
28
29
30
34
36
38
40
42
44
48
50
52
54
56
58
59
60
62
64
68
70
72
74
75
76
78
80
82
84
88
90
92
94
96
98
100

HYDROCRACKING PROCESS FOR MAKING MIDDLE DISTILLATE FROM A LIGHT HYDROCARBON FEEDSTOCK

CROSS-REFERENCE TO RELATED APPLICATION

This application claims the benefit of U.S. Provisional Patent Application 62/676,406 filed May 25, 2018 entitled A HYDROCRACKING PROCESS FOR MAKING MIDDLE DISTILLATE FROM A LIGHT HYDROCARBON FEEDSTOCK, the entirety of which is incorporated by reference herein.

FIELD OF THE INVENTION

This invention relates to a hydrocracking process for preferentially making middle distillate such as diesel from a relatively light hydrocarbon feedstock such as light vacuum gas oil.

BACKGROUND

Refineries commonly apply hydrocracking processes to convert high boiling hydrocarbon feedstocks to produce more valuable products such as naphtha and the middle distillates. The hydrocracking process also can provide for removal of organic sulfur and organic nitrogen from the feedstocks by application of a hydrotreating step that is a part of an overall hydrocracking process.

Hydrocracking is generally carried out by contacting gas oil or other heavy hydrocarbon feedstocks with a hydrocracking catalyst contained within a reaction vessel in the presence of hydrogen gas under elevated reaction temperatures and pressures to yield lighter, more valuable hydrocarbon products. These products typically boil within the gasoline boiling range of from 85° C. (185° F.) to 215° C. (419° F.) and the middle distillate boiling range of from 150° C. (302° F.) to 425° C. (797° F.). The hydrocracking catalyst typically includes a hydrogenation metal component, crystalline aluminosilicate material such as X-type and Y-type zeolite, and a refractory inorganic oxide such as silica, alumina, or silica-alumina.

The hydrocracking process typically includes a pretreating step followed by a hydrocracking step or, with some processes, two hydrocracking steps. The pretreating step provides for hydrodesulfurization and hydrodenitrogenation of the organo sulfur and organonitrogen compounds in the hydrocarbon feedstock to convert them by hydrogenation to hydrogen sulfide and ammonia. The pretreating catalyst typically includes a Group VIII metal component and a Group VI metal component supported or combined with an inorganic oxide matrix material.

One type of two-stage hydrocracking process is disclosed in U.S. Pat. No. 3,726,788. This two-stage process includes two fractionation steps and two hydrocracking stages to process a highly aromatic hydrocarbon feedstock to obtain a high-aromatic naphtha product and a low-aromatic turbine fuel product. The first hydrocracking stage is carried out in the presence of hydrogen sulfide and ammonia in order to suppress the hydrogenation of aromatics. The presence of ammonia in the first hydrocracking stage feed acts to inhibit the hydrocracking catalyst activity that results in suppressing the hydrogenation of aromatics. A combination of a flash separation and a first stage fractionation is intermediate between the first hydrocracking stage and the second hydrocracking stage.

The combination of flash and fractionation separations provides a high boiling, high aromatics hydrocarbon stream having a low concentration of ammonia and hydrogen sulfide that is mixed with hydrogen treat gas, which contains little or no ammonia but has a controlled concentration of hydrogen sulfide. This mixed stream is introduced into the second hydrocracking stage. The controlled concentration of hydrogen sulfide of the hydrogen treat gas suppresses hydrogenation of aromatics. This hydrogen sulfide concentration is controlled also to provide for low aromatic naphtha and low aromatic turbine fuel products that meet desired aromatics specifications.

There is no suggestion that the two-stage hydrocracking process of the '788 patent can provide for easy processing of a light gas oil feedstock that selectively produces middle distillate and, specifically, produces high quality, low-sulfur diesel. The process of the '788 patent requires use of two fractionation steps with the first fractionation step intermediate between the two hydrocracking stages. The first stage fractionator bottoms of the process of the '788 patent is introduced into the second stage hydrocracking reactor, and it is not passed to the second stage fractionator. It further is noted that there is no suggestion by the '788 patent of the use of stacked beds of different types of functional catalysts providing for the selective production of middle distillate and providing for operating flexibility.

Another two-stage hydrocracking process is disclosed in U.S. Pat. No. 3,816,296. This process provides for hydrocracking heavy hydrocarbons boiling above 700° F. to selectively produce midbarrel fuels boiling between 300° F. and 700° F. and lower boiling products such as gasoline or naphtha fractions. The yield of these products for a given hydrocracking conversion is controlled and changed as desired by the controlled addition of certain nitrogen-containing compounds to the second-stage hydrocracking zone of the process. The nitrogen compounds include ammonia and other nitrogen-containing compounds convertible to ammonia in the hydrocracking zone.

The midbarrel hydrocracking catalyst of the process of the '296 patent comprises refractory oxide support that is at least about 50 weight percent amorphous alumina, has less than 30 weight percent crystalline zeolite, and a hydrogenation active component.

The process of the '296 patent includes a high-pressure scrubber-separator and a fractionator positioned between an initial hydrocracking reaction stage and the second hydrocracking reaction stage. The effluent from the initial hydrocracking reaction stage passes to the high-pressure scrubber-separator that provides for water scrubbing the effluent to remove ammonia and hydrogen sulfide. The scrubbed effluent passes to the fractionator, which separates it into gasoline range hydrocarbons boiling below 400° F., midbarrel fuels boiling between the gasoline cut point and about 700° F., and unconverted hydrocarbons boiling above about 700° F. The nitrogen compounds are added to the unconverted hydrocarbons that are passed to the second hydrocracking reaction stage. The effluent from the second hydrocracking reaction stage is passed to a separator and the separated liquid is recycled to the fractionator.

A required feature of the process of the '296 patent is the use of a fractionation step between the first stage hydrocracking reactor and the second stage hydrocracking reactor. There is no suggestion of the use of stacked beds of different types of functional catalyst providing for the selective production of middle distillate and providing for operating flexibility. The use of quench gas to assist in control of the reaction temperatures of the hydrocracking reaction stages is not recognized by the '296 patent.

Another patent, U.S. Pat. No. 8,318,006, discloses a once-through hydrocracking process. A feature of this process is an intermediate hot flash step placed between a hydrorefining step and a hydrocracking step. The intermediate hot flash provides for the separation of at least a portion of the ammonia from the effluent leaving the hydrorefining step. There is no distillation of the liquid effluent from the intermediate hot flash step before its introduction into the second reaction step of the process. The second reaction zone preferably comprises at least one bed of hydrorefining catalyst upstream of at least one bed of hydrocracking catalyst. There is no disclosure by the '006 patent of the use of quench gas to control hydrocracking reaction temperature within the second reaction zone. Controlling the quantity of ammonia admitted to the hydrocracking step increases the flexibility of the process and provides for improvement in the middle distillate selectivity of the hydrocracking catalyst.

It is sometimes desirable to process light gas oil feedstocks that are only slightly heavier than diesel fuel in a hydrocracking unit to preferentially yield diesel instead of naphtha or gasoline. It can be difficult, however, to hydrocrack gas oil that is only slightly heavier than diesel to make a high-quality diesel product, because their boiling temperatures can overlap which makes it difficult to control the amount of cracking to yield diesel instead of naphtha or gasoline.

Also, market economics sometimes make it beneficial to change the operation of a hydrocracking unit from a gasoline production operating mode to a distillate or diesel production operating mode. Thus, hydrocracker unit operating flexibility can be important to maximizing its operating economics. When operating a hydrocracking unit in a diesel production mode, the diesel should be high quality and meet ultra-low sulfur diesel specifications. Thus, it is important for the hydrocracking unit to include features providing for its operation to make high quality, ultra-low sulfur diesel.

SUMMARY

Accordingly, provided is a hydrocracking process for converting a light gas oil feedstock to yield a diesel product. In this hydrocracking process, the light gas oil feedstock is introduced into a first reaction zone defined by a first reactor and containing a first pretreating catalyst and whereby a first reactor effluent is yielded from the first reaction zone. The first reactor effluent is introduced into a second reaction zone defined by a second reactor and containing a first hydrocracking catalyst and whereby a second reactor effluent is yielded from the second reaction zone. The second reactor effluent is introduced into a first separation zone defined by a first separator vessel providing means for separating the second reactor effluent into a first separator vapor and a first separator liquid. The first separated liquid is introduced into a third reaction zone defined by a third reactor, wherein within the third reaction zone is included a top bed, comprising a second pretreating catalyst, and a bottom bed, comprising a second hydrocracking catalyst. A third reactor effluent is yielded from the third reaction zone. The third reactor effluent is introduced into a second separation zone defined by a second separator vessel providing means for separating the third reactor effluent into a second separator vapor and a second separator liquid. The second separator liquid is introduced into a main fractionator providing for the distillation separation of the second separator liquid to yield at least a bottoms product and another product.

BRIEF DESCRIPTION OF THE DRAWINGS

The FIGURE presents a process flow diagram of one embodiment of the inventive two-stage hydrocracking process for converting hydrocarbon feedstocks preferentially to yield a middle distillate product.

DETAILED DESCRIPTION

The invention relates to a two-stage hydrocracking process for converting a light gas oil feedstock to selectively or preferentially yield middle distillate products, and, particularly, ultra-low sulfur diesel. The inventive process includes elements and features that provide for flexible operation of the two-stage hydrocracking process between a naphtha production operating mode and a diesel production operating mode. The process further provides for hydrocracking a light gas oil feedstock having a boiling range overlapping the boiling range of diesel but shifted such that it is slightly higher than the boiling range of diesel. This feedstock is relatively lighter than most typical gas oil feedstocks processed by hydrocracker units; and, because of this, it is more difficult to process to selectively yield diesel instead of gasoline and to yield a good quality diesel product such as ultra-low sulfur diesel.

The light gas oil feedstock may be from any hydrocarbon source, for example, petroleum crude oil. It is typically an atmospheric distillate or a light vacuum distillate of petroleum crude oil. The light gas oil feedstock may be characterized as having an initial boiling temperature greater than about 135° C. (275° F.) and a final boiling temperature of less than about 440° C. (824° F.). More specifically, the temperature at which 10 volume percent of the light gas oil is recovered using the distillation testing method ASTM D-86, i.e., T(10), is greater than or about 135° C. (275° F.), preferably, greater than 150° C. (302° F.), and, most preferably, greater than or about 165° C. (329° F.). The temperature at which 90 volume percent of the light gas oil is recovered using the distillation testing method ASTM D-86, i.e., T(90), is less than or about 424° C. (797° F.), preferably, less than or about 400° C. (752° F.), and, more preferably, less than or about 375° C. (707° F.).

The sulfur content of the light gas oil feedstock is generally in the range of upwardly 5 weight percent of the feedstock. It is more typically in the range of from 0.1 wt. % to 5 wt. %, and, most typically, from 0.5 wt. % to 4 wt. % or 0.75 wt. % to 3 wt. %. The sulfur content may be determined by the testing method ASTM D 5453 or any other suitable or comparable testing method.

The nitrogen content of the light gas oil feedstock is normally greater than 500 parts per million by weight (ppmw) and usually in the range of from 500 ppmw to 5,000 ppmw. More typically, the nitrogen content of the light gas oil feedstock is in the range of from 700 ppmw to 4,000 ppmw. The nitrogen content may be determined by the testing method ASTM D5762 or any other suitable or comparable testing method.

The diesel product provided by the inventive hydrocracking process has a significantly reduced sulfur content over that of its light gas oil feedstock. The process will typically provide a diesel product having a sulfur content that is less than 50 ppmw, and, preferably, the sulfur content is less than 10 ppmw. The nitrogen content is significantly reduced as well. The nitrogen content of the diesel product is typically reduced to less than 50 ppmw, and it usually is in the range of from 1 to 10 ppmw.

The middle distillates yielded from the inventive hydrocracking process can include kerosene and diesel. While it is not preferred, the process may also yield a product boiling within the naphtha boiling range. It is preferred, however, to operate the process in a diesel production mode to preferentially yield and produce a diesel product. Indeed, one aspect of the inventive process is that it provides for the selective production of diesel as opposed to kerosene and naphtha.

The diesel product of the process is characterized as having an initial boiling temperature between 125° C. (257° F.) and 150° C. (302° F.) and a final boiling temperature between 370° C. (698° F.) and 400° C. (752° F.). It is preferred for the diesel product to have a T(90) temperature in the range of from 282° C. (540° F.) to 338° C. (640° F.).

The first step of the inventive process includes passing the light gas oil feedstock (feedstock) to the first reactor of the process unit and introducing it along with added hydrogen gas into the first reaction zone defined by the first reactor. Contained within the first reaction zone is a bed of first pretreating catalyst with which the feedstock is contacted in the presence of the hydrogen gas under suitable hydrotreating (i.e., hydrodesulfurization and hydrodenitrogenation) reaction conditions sufficient to convert a significant portion of the organic sulfur compounds of the feedstock to hydrogen sulfide and a significant portion of the organic nitrogen compounds of the feedstock to ammonia.

The first pretreating catalyst may be any known hydrotreating catalyst that suitably provides for the hydrodesulfurization and hydrodenitrogenation of the feedstock. Generally, the first pretreating catalyst comprises an inorganic oxide support material, such as alumina, silica, and silica-alumina, and a hydrogenation metal component. The hydrogenation metal may be a Group VIII metal (nickel or cobalt) or a Group VI metal (molybdenum or tungsten) or any combination thereof. Typically, the Group VIII metal is present in the first pretreating catalyst at a concentration in the range of from 1 to 20 weight percent, based on the oxide and total weight of the catalyst, and the Group VI metal is present at a concentration in the range of from 1 to 20 weight percent, based on the oxide and the total weight of the catalyst. Various of the hydrorefining catalysts disclosed and described in U.S. Pat. No. 8,318,006 may suitably be used as the first pretreating catalyst of the process. U.S. Pat. No. 8,318,006 is incorporated herein by reference.

The hydrotreating reaction conditions under which the first reaction zone is operated include a hydrotreating temperature in the range of from about 550° F. to about 850° F. and a hydrotreating pressure in the range of from about 1400 psi to 2000 psi. The liquid hourly space velocity (LHSV) is in the range of from about 0.1 $hr^{-1}$ to 10 $hr^{-1}$. The hydrogen treat gas rate is in the range of from about 500 scf per barrel of feedstock to about 8000 scf per barrel of feedstock. The hydrotreating reaction conditions within the first reaction zone are controlled to obtain a conversion of from 95 to 99.9 weight percent of the organic sulfur in the feedstock to hydrogen sulfide and from 95 to 99.9 weight percent of the organic nitrogen in the feedstock to ammonia.

A first reactor effluent is yielded from the first reaction zone of the first reactor. The first reactor effluent passes from the first reaction zone and is introduced along with added hydrogen gas into the second reaction zone defined by a second reactor. Contained within the second reaction zone is a bed of first hydrocracking catalyst with which the first reactor effluent is contacted in the presence of the hydrogen gas under suitable hydrocracking reaction conditions sufficient to provide a desired amount of hydrocracking of the first reactor effluent.

The first hydrocracking catalyst may be any known hydrocracking catalyst that suitably provides for the desired first stage cracking of the first reactor effluent. Generally, the first hydrocracking catalyst comprises a zeolite component, an inorganic oxide component, and a hydrogenation metal component.

Various zeolites that may be suitable components of the first hydrocracking catalyst include, for example, zeolite X, zeolite Y, zeolite beta, and ZSM-5. The zeolite component may be present in the first hydrocracking catalyst in an amount up to about 80 wt. % of the catalyst.

The inorganic oxide component may be selected from the group consisting of alumina, silica, titania, silica-alumina and combinations thereof, and it is present in the first hydrocracking catalyst in an amount exceeding 25 wt. % of the catalyst.

The hydrogenation metal component includes nickel or cobalt, or both, that may be present in the first hydrocracking catalyst in an amount in the range of from about 1 to 10 wt. % of the catalyst. The hydrogenation metal component further may include tungsten or molybdenum, or both, and, if present, the amount present in the first hydrocracking catalyst is in the range of from 5 to 25 wt. % of the catalyst. The first hydrocracking catalyst may also include a combination of either nickel or cobalt with either molybdenum or tungsten.

Various of the hydrocracking catalysts disclosed and described in U.S. Pat. No. 8,318,006 may suitably be used as the first hydrocracking catalyst. Other possible hydrocracking catalyst compositions are disclosed and described in U.S. Pat. Nos. 7,749,373; 7,192,900; and 7,048,845. These patents are incorporated herein by reference.

The hydrocracking reaction conditions under which the second reaction zone is operated include a hydrocracking temperature in the range of from about 550° F. to about 850° F. and a hydrocracking pressure in the range of from about 1400 psi to 2000 psi. The liquid hourly space velocity (LHSV) is in the range of from about 0.1 $hr^{-1}$ to 10 $hr^{-1}$. The amount of hydrogen mixed with the first reactor effluent is in the range of from about 500 to about 8000 scf per barrel of first reactor effluent introduced into the second reaction zone. The hydrocracking reaction conditions within the second reaction zone are controlled to obtain a desired conversion of the first reactor effluent.

A second reactor effluent is yielded from the second reaction zone of the second reactor and passed to a water wash step. In the water wash step, the second reactor effluent is mixed with wash water that provides for removing at least a portion of the ammonia and hydrogen sulfide contained in the second reactor effluent. Separation of the water phase comprising the removed ammonia and hydrogen sulfide occurs within a separation zone defined by a separator vessel providing means for separating the mixture of wash water and second reactor effluent to yield a second reactor effluent, having been scrubbed of ammonia and hydrogen sulfide, and a water phase, containing ammonia and hydrogen sulfide.

The scrubbed second reactor effluent is then passed and introduced into a first separation zone defined by a first separator vessel. The first separator vessel provides means for separating the second reactor effluent into a first separator vapor, which comprises hydrogen gas as a major portion of the first separator vapor, and a first separator liquid. The first separation zone is operated under high pressure conditions that preferably approximate the operating pressure of the second reaction zone. Typically, the phase separation within the first separation zone is a single-stage, gravitational, vapor-liquid phase separation.

The first separator liquid is then passed as a feed to a third reaction zone defined by a third reactor. A necessary feature of the inventive process is that there is no intermediate fractionation or fractional separation of the first separator liquid before it is charged and introduced into the third reaction zone. Instead, the first separator liquid is passed directly to the third reaction zone.

It is an essential feature of the process for the third reaction zone to include stacked beds of catalyst instead of a single catalyst bed. It further is a feature of the third reaction zone that its upper portion includes a top bed of second pretreating catalyst instead of hydrocracking catalyst and that its lower portion includes a bottom bed of second hydrocracking catalyst.

The placement of the second pretreating catalyst into the upper portion of the third reaction zone provides several benefits in the overall operation of the inventive hydrocracking process. One such benefit is that it allows for greater flexibility in operating the inventive hydrocracking process to selectively make a high quality diesel product. It does this by helping to control the hydrocracking temperature within the bottom bed of second hydrocracking catalyst in the lower portion of the third reaction zone. The top bed that comprises the second pretreating catalyst fills up a portion of the third reaction zone with catalyst having no or little hydrocracking function resulting in less total hydrocracking catalyst contained within the third reactor and providing less hydrocracking than that which would be provided by a reactor vessel full of a hydrocracking catalyst. This reduction in the amount of hydrocracking is required due to the processing of a light gas oil feedstock, as defined herein, to selectively yield a diesel product instead of light naphtha and kerosene products.

Another benefit from the placement of the second pretreating catalyst in the third reaction zone as a top bed is that provides it provides for hydrogenation of organic sulfur and organic nitrogen compounds that were not hydrogenated in the first step of the process and that remain in the first separator liquid. The hydrogenation of these compounds yield small amounts of ammonia and hydrogen sulfide. The ammonia tends to suppress the hydrocracking activity of the second hydrocracking catalyst and provide for better diesel yield.

The total volume of the third reaction zone defined by the third reactor vessel includes a top bed volume of the second pretreating catalyst and bottom bed volume of the second hydrocracking catalyst. To achieve the benefits from a stacked-bed arrangement, the ratio of top bed volume-to-bottom bed volume within the third reaction zone should be within the range of 0.1:1 to 1.5:1. Preferably, this volumetric ratio is in the range of from 0.2:1 to 1.2:1, and, most preferably, the ratio of top bed volume-to-bottom bed volume is in the range of from 0.5:1 to 1:1. The volume of each catalyst bed may be represented by the cross sectional area of the catalyst bed multiplied by the height of the catalyst bed.

The second pretreating catalyst is any known hydrotreating catalyst that suitably provides for the hydrodesulfurization and hydrodenitrogenation of the first separator liquid in accordance with the invention. The second pretreating catalyst may be the same or similar to the first pretreating catalyst as described above and may comprise an inorganic oxide support material, such as alumina, silica, and silica-alumina, and a hydrogenation metal component. The hydrogenation metal component may be either nickel or cobalt that may or may not be combined with molybdenum or tungsten, or both. The nickel or cobalt metal component is present in the second pretreating catalyst at a concentration in the range of from 1 to 20 weight percent, based on the oxide and the total weight of the catalyst, and the molybdenum or tungsten component, when present, is at a concentration in the range of from 1 to 20 weight percent, based on the oxide and the total weight of the catalyst.

The cracking reaction within the bottom bed is further controlled by the introduction of lower temperature quench gas into the third reaction zone so as to control the cracking reaction temperature within the bottom bed. The quench gas comprises hydrogen gas and has a temperature significantly below the temperature within the third reaction zone and in particular within its bottom bed. Control of the diesel selectivity of the cracking reaction is assisted by controlling the cracking temperature within the bottom bed.

Additional control of the temperature within the bottom bed of the third reaction zone so as to control the diesel selectivity of the cracking reaction therein is achieved by admixing with the first separator liquid a nitrogen-containing compound selected from the group consisting of ammonia and organic amine compounds capable of conversion to ammonia under the conditions within the third reaction zone. The organic amine compounds preferably are selected from primary, secondary and tertiary alkyl amines having from one to 15 carbon atoms per molecule. One non-limiting example of a suitable alkyl amine is tributylamine. The amount of the nitrogen-containing compound added to the first separator liquid is such as to provide a nitrogen concentration in the first separator liquid hydrocarbon in the range of from 1 to 1,000 ppmw, preferably, from 5 to 500 ppmw, and, most preferably, from 10 to 200 ppmw.

In an embodiment of the inventive hydrocracking process, diesel selectivity and product quality can be improved by using a specific catalyst composition as the second hydrocracking catalyst of the bottom bed of the third reactor. In this embodiment, the second hydrocracking catalyst comprises less than 50 wt. % amorphous alumina, greater than 30 wt. % crystalline zeolite, and a catalytic metal component. The zeolite and catalytic metal components of the second hydrocracking catalyst may be the same as those mentioned above with respect to the first hydrocracking catalyst.

The reaction conditions within the third reaction zone include a third reactor temperature in the range of from about 550° F. to about 850° F. and a third reactor pressure in the range of from about 1400 psi to 2000 psi. The liquid hourly space velocity (LHSV), based on the volume of the second hydrocracking catalyst, is in the range of from about 0.1 $hr^{-1}$ to 10 $hr^{-1}$. The amount of hydrogen mixed with the first separator liquid is in the range of from about 500 to about 8000 scf per barrel of first separator liquid introduced into the third reaction zone. The reaction conditions within the third reaction zone are controlled to obtain a desired quality and yield of diesel product.

A third reactor effluent is yielded from the third reaction zone and introduced into a second separation zone defined by a second separator vessel. The second separator vessel provides means for separating the third reactor effluent into a second separator vapor, which comprises hydrogen gas as a major portion of the second separator vapor, and a second separator liquid. The second separation zone is operated under high pressure conditions that preferably approximate the operating pressure of the third reaction zone. Typically, the phase separation within the second separation zone is a single-stage, gravitational, vapor-liquid phase separation.

The second separator liquid is introduced into a main fractionator providing means for distillation separation of the second separator liquid to yield a heavy bottoms product and one or more products that include a final diesel product of the inventive process. Other possible product streams from the main fractionator may include an overhead product, comprising light paraffins, a naphtha product, and a kerosene product. The kerosene product is characterized as having a maximum T(10) of 205° C. (401° F.) and a maximum end point of 300° C. (572° F.). The naphtha product may include hydrocarbons having boiling temperatures in the range of from about 40° C. (104° F.) to 220° C. (428° F.). The main fractionator may be any suitable equipment or design known to or designable by those skilled in the art of distillation.

In an embodiment of the process, the bottoms product of the main fractionator comprises predominately hydrocarbons having boiling temperatures greater than 371° C. (700° F.) and is recycled as a feed that is introduced into the third reaction zone. While it is preferred to recycle the heavy bottoms product to the third reactor, it may alternatively be recycled and introduced into the first separation zone, or a first portion of the bottoms product may be recycled as a feed to the third reactor and a second portion of the bottoms product may be recycled as a feed to the first separator. In another embodiment of the process, the heavy bottoms may be recycled as a feed to the second reactor, or a portion of the heavy bottoms may be recycled as a feed to the second reaction zone and the remaining portion of the heavy bottoms product is recycled to the third reaction zone.

The FIGURE presents a process flow diagram of one embodiment of the inventive two-stage hydrocracking process 10 that is provided for illustration. In two-stage hydrocracking process 10, a light gas oil feedstock passing through line 12 is mixed with hydrogen gas that is introduced into the light gas oil feedstock by way of line 14. The mixture of light gas oil feedstock and hydrogen gas passes by way of line 22 and is introduced into first reaction zone 16, which is defined by first reactor 18 and contains first pretreating catalyst 20.

First reaction zone 16 is operated under suitable hydrotreating reaction conditions to provide a first reactor effluent that passes from first reaction zone 16 by way of line 24 and is introduced into second reaction zone 26. Second reaction zone 26 is defined by second reactor 28 that contains first hydrocracking catalyst 30. In an embodiment of two-stage hydrocracking process 10, a nitrogen-containing compound passes through line 29 and is mixed with the first reactor effluent passing through line 24 for introduction into second reaction zone 26 to function as a modifier of the cracking activity of first hydrocracking catalyst 30 to favor diesel selectivity.

Second reaction zone 26 is operated under hydrocracking conditions suitable for providing a desired conversion of the first reactor effluent to yield a second reactor effluent. Second reactor effluent passes from second reaction zone 26 by way of line 34 and is mixed with wash water that passes by way of line 36 into a water washing system 38. Water washing system 38 includes separator vessel 40 that defines separation zone 42. Separator vessel 40 provides means for separating the mixture of wash water and second reactor effluent to yield a second reactor effluent having been scrubbed of ammonia and hydrogen sulfide and a water phase containing the separated ammonia and hydrogen sulfide. The water phase, containing ammonia and hydrogen sulfide, passes from water washing system 38 and separation zone 42 through line 44.

The scrubbed second reactor effluent passes from separation zone 42 through line 48 and is introduced into first separation zone 50. First separator 52 defines first separation zone 50 and provides means for separating the scrubbed second reactor effluent into a first separator vapor and a first separator liquid.

The first separator vapor passes from first separation zone 50 by way of line 54, and the first separator liquid passes from first separation zone 50 through line 56 and is introduced into third reaction zone 58. A nitrogen-containing compound passing through line 59 is admixed with the first separator liquid before its introduction into third reaction zone 58. Third reactor 60 defines third reaction zone 58 having upper portion 62 and a lower portion 64. Upper portion 62 includes top bed 68 containing second pretreating catalyst 70 and bottom bed 72 containing second hydrocracking catalyst 74. Third reaction zone 58 is operated under reaction conditions suitable to provide desired yields and quality of the final diesel product of the two-stage hydrocracking process 10.

Hydrocracking reaction temperature conditions within bottom bed 72 may further be controlled by passing quench gas, comprising hydrogen, through line 75 and introducing it into third reaction zone 58. The control of bottom bed 72 reaction temperature provides for additional control of the diesel selectivity of the cracking reaction.

A third reactor effluent passes from third reaction zone 58 through line 76 and is introduced into second separation zone 78 that is defined by second separator 80. Second separator 80 provides means for separating the third reactor effluent into a second separator vapor and a second separator liquid. The second separator vapor passes from second separation zone 78 by way of line 82 and second separator liquid passes from second separation zone 78 through line 84 to main fractionator 88.

The second separator liquid is introduced as a feed into main fractionator 88. Main fractionator 88 provides means for distilling the second separator liquid to yield a heavy bottoms product and one or more other products that include the final diesel product of the two-stage hydrocracking process 10. The diesel product is recovered and passes from distillation zone 90 through line 92. Other products such as kerosene, naphtha and light hydrocarbons may be recovered and pass from distillation zone 90 respectively through lines 94, 96 and 98.

A heavy bottoms product passes from distillation zone 90 of main fractionator 88 through line 100 and is introduced as a feed into third reaction zone 58 of third reactor 60. In another embodiment, the heavy bottoms product may be introduced by way of line 24 into second reaction zone 26, or a first portion of the heavy bottoms product is introduced by way of line 24 into second reaction zone 26 and a second portion of the heavy bottoms product is introduced by way of line 56 into third reaction zone 58.

That which is claimed:

1. A two-stage hydrocracking process for converting a light gas oil feedstock to produce a diesel product, wherein said hydrocracking process comprises:

introducing said light gas oil feedstock, having a T(10) greater than or about 135° C. and a T(90) of less than or about 424° C., into a first reaction zone defined by a first reactor and containing a first pretreating catalyst, comprising an inorganic oxide support material selected from alumina, silica, and silica-alumina, and a hydrogenation metal component;

yielding from said first reaction zone a first reactor effluent;

introducing said first reactor effluent into a second reaction zone defined by a second reactor and containing a first hydrocracking catalyst, comprising a zeolite component selected from zeolite X, zeolite Y, zeolite beta, and ZSM-5, in an amount up to about 80 wt. % of said first hydrocracking catalyst, an inorganic oxide component, and a hydrogenation metal component;

yielding from said second reaction zone a second reactor effluent;

mixing said second reactor effluent with wash water to provide for removing at least a portion of ammonia and hydrogen sulfide contained in said second reactor effluent and separating a water phase comprising removed ammonia and hydrogen sulfide and a scrubbed second reactor effluent;

introducing said scrubbed second reactor effluent into a first separation zone defined by a first separator vessel providing means for separating said scrubbed second reactor effluent into a first separator vapor and a first separator liquid;

introducing said first separator liquid into a third reaction zone defined by a third reactor, wherein within said third reaction zone is included a top bed having a top bed volume and comprising a second pretreating catalyst, comprising an inorganic oxide support material selected from alumina, silica, and silica-alumina, and a hydrogenation metal component, and a bottom bed having a bottom bed volume and comprising a second hydrocracking catalyst, wherein said second hydrocracking catalyst comprises less than 50 weight percent amorphous alumina, greater than 30 weight percent crystalline zeolite, and a catalytic metal component, wherein the ratio of top bed volume to bottom bed volume is in the range of from 0.1:1 to 1.5:1;

admixing with said first separator liquid an effective amount of a nitrogen-containing compound so as to modify cracking activity of said second hydrocracking catalyst of said bottom bed within said third reaction zone to enhance its diesel selectivity;

yielding from said third reaction zone a third reactor effluent;

introducing said third reactor effluent into a second separation zone defined by a second separator vessel providing means for separating said third reactor effluent into a second separator vapor and a second separator liquid;

introducing said second separator liquid into a main fractionator providing for distillation separation of said second separator liquid to yield at least a bottoms product and another product including a diesel product having an initial boiling temperature between 125° C. and 150° C. and a final boiling temperature between 370° C. and 400° C.; and recycling at least a portion of said bottoms product as a feed to said second reaction zone.

2. The hydrocracking process as recited in claim 1, further comprising:

introducing said bottoms product into said third reaction zone or said first separation zone, or both.

3. The hydrocracking process as recited in claim 1, further comprising:

admixing with said first reactor effluent an effective amount of a nitrogen-containing compound so as to modify cracking activity of said first hydrocracking catalyst within said second reaction zone to enhance its diesel selectivity.

4. The hydrocracking process as recited in claim 1, further comprising:

introducing quench gas into said third reaction zone so as to control diesel selectivity of cracking reaction by controlling the cracking temperature within said bottom bed of said third reaction zone.

5. The hydrocracking process as recited in claim 1, wherein said light gas oil feedstock is characterized as having a T90 of less than 800° F., a nitrogen content in the range of from 500 to 10,000 ppmw, and a sulfur content in the range of from 0.01% to 5% by weight.

6. A hydrocracking process as recited in claim 1, wherein said nitrogen-containing compound is selected from the group consisting of ammonia and organic amine compounds capable of conversion to ammonia under conditions of said third reactor in an amount to provide a concentration of said nitrogen-containing compound in said first separator liquid in the range of from 1 to 1,000 ppmw.

* * * * *